US007861872B2

(12) United States Patent
Ng et al.

(10) Patent No.: US 7,861,872 B2
(45) Date of Patent: Jan. 4, 2011

(54) TROLLEY AND SPREADER ASSEMBLY

(75) Inventors: Ghee Hua Ng, Singapore (SG); Robert Arthur Mills, Chorley (GB)

(73) Assignee: NSL Engineering Pte Ltd, Singapore (SG)

( * ) Notice: Subject to any disclaimer, the term of this patent is extended or adjusted under 35 U.S.C. 154(b) by 0 days.

(21) Appl. No.: 11/883,730

(22) PCT Filed: Jan. 27, 2006

(86) PCT No.: PCT/SG2006/000016

§ 371 (c)(1),
(2), (4) Date: Oct. 17, 2007

(87) PCT Pub. No.: WO2006/083231

PCT Pub. Date: Aug. 10, 2006

(65) Prior Publication Data

US 2008/0135510 A1 Jun. 12, 2008

(30) Foreign Application Priority Data

Feb. 2, 2005 (SG) ..... 200500669-7

(51) Int. Cl.
*B66C 17/20* (2006.01)

(52) U.S. Cl. ..... 212/316; 212/326

(58) Field of Classification Search ..... 212/316, 212/274, 323, 326

See application file for complete search history.

(56) References Cited

U.S. PATENT DOCUMENTS

| | | | | | |
|---|---|---|---|---|---|
| 3,179,259 | A | * | 4/1965 | McLean | 212/274 |
| 3,671,069 | A | * | 6/1972 | Martin et al. | 294/81.1 |
| 3,825,128 | A | * | 7/1974 | Cooper | 212/274 |
| 3,828,940 | A | * | 8/1974 | Cooper | 212/308 |
| 3,842,986 | A | * | 10/1974 | Hupkes | 212/330 |
| 3,854,592 | A | * | 12/1974 | Mordre | 212/226 |
| 4,214,664 | A | * | 7/1980 | Polen | 212/274 |
| 4,360,304 | A | * | 11/1982 | Brewer et al. | 414/191 |
| 5,018,631 | A | | 5/1991 | Reimer | |
| 5,257,891 | A | * | 11/1993 | Baumann et al. | 414/460 |
| 5,819,962 | A | * | 10/1998 | Okubo et al. | 212/275 |
| 7,150,366 | B1 | * | 12/2006 | Zakula et al. | 212/272 |
| 2003/0189348 | A1 | | 10/2003 | Lindstrom | |
| 2006/0043748 | A1 | * | 3/2006 | Stinis et al. | 294/81.51 |

FOREIGN PATENT DOCUMENTS

| | | | |
|---|---|---|---|
| DE | 1 531 273 | * | 12/1969 |
| EP | 0123846 | | 11/1984 |
| JP | 54-6267 A | * | 1/1979 |
| JP | 54-47264 A | * | 4/1979 |
| SU | 1057403 A | * | 11/1983 |

* cited by examiner

*Primary Examiner*—Thomas J Brahan
(74) *Attorney, Agent, or Firm*—Reed Smith LLP; Carl H. Pierce

(57) ABSTRACT

A trolley assembly (200) comprising means for supporting a spreader assembly (300), said means including cables (20), said spreader assembly (300) adapted to engage at least one freight device; a first carrier portion and a second carrier portion; the supporting means adapted to connect the spreader assembly (300) to at least one of said carrier portions and; a trolley separation means for selectively varying the relative position of the first and second carrier portions wherein the adjustment of the trolley separation means is such that the cables (20) are maintained in a substantially vertical orientation.

16 Claims, 7 Drawing Sheets

TROLLEY AND SPREADER ASSEMBLY

FIELD OF THE INVENTION

The invention relates to apparatus, such as hoists and spreaders, required for manipulating freight devices, for example shipping containers and flat racks. Further, the apparatus of the present invention is applicable to the manipulation of multiple freight devices simultaneously.

BACKGROUND OF THE INVENTION

To increase the economic viability of transporting freight, port authorities invest significant capital into infrastructure to facilitate the efficient loading and unloading of containers from ships at dock. The infrastructure is geared to move said containers to storage facilities ready for delivery via land transport or directly from ships to the land transport.

Recently, to increase efficiency and therefore economic viability, inventions facilitating the movement of several containers simultaneously have been developed. One such invention is disclosed in WO 01/98195, the contents of which are incorporated herein by reference. This invention incorporates a spreader having connection to two container engagement frames, which may engage with one or two containers. It follows that this will immediately increase the rate for which a ship may be loaded or unloaded, and therefore the efficiency of the process.

A disadvantage of this invention is the connectivity between the spreader and engagement frames. As shown in the various figures of WO 01/98195, the engagement frames are connected to the spreader either by chains or pin-jointed tie rods.

If this arrangement were to pick up one container only or two containers of substantially varying weights, then a redistribution of the weight would lead to the spreader listing to one side due to the unbalanced force. Thus, this arrangement is restricted to lifting containers of substantially similar weights. In the loading and unloading procedure however, the only time an operator will be assured of lifting two containers of similar weight will be when the containers are empty. Thus whilst this invention is useful in moving multiple containers, in a practical sense, it may be restricted to the safe movement of empty containers only.

This development has been built on by the invention of WO 03/104132, the contents of which are incorporated herein by reference. This invention is an improvement over first in that the connection between the spreader and the container engagement frames is releasably fixed, so removing the degrees of freedom inherent with the use of the chain or pin-jointed tie rods of the previous invention. Further, to prevent the spreader frames from listing, the invention WO 03/104132 provides a hydraulically powered assembly capable of separating the engagement frames, so that adjacent containers do not interfere with each other and are therefore held in a fixed relation to each other. This has the advantage of maintaining a degree of control over the load, which is not possible with the invention of WO 01/98195.

Nevertheless, the invention of WO 03/104132 is still subject to existing infrastructure and therefore any imbalance of load through a mismatch of weights of the lifted containers may lead to the same rotation at the point at which the cables engaging the spreader to the hoist are joined. Thus whilst the spreader and engagement frames are stable, the cable would still permit rotation as the unbalanced load is redistributed. As with the previous invention, the redistribution and consequential rotation of the spreader frame may lead to difficulties in placing the containers either on the dock or on a ship.

It would be advantageous to have a system whereby containers having a weight differential can be lifted without suffering the detrimental effects of a redistribution of load.

SUMMARY OF INVENTION

It is therefore an object of the present invention to minimize rotation of the spreader or engagement frames through a load redistribution when lifting containers of differing weight.

In a first aspect, the invention provides a trolley assembly comprising means for supporting a spreader assembly, said means including cables, said spreader assembly adapted to engage at least one freight device; a first carrier portion and a second carrier portion; the supporting means adapted to connect the spreader assembly to at least one of said carrier portions and a trolley separation means for selectively varying the relative position of the first and second carrier portions wherein the adjustment of the trolley separation means is such that the cables are maintained in a substantially vertical orientation.

In a preferred embodiment, the first and second carrier portions may be discreet trolleys, which may be in rolling engagement with a rail or a crane beam. In a more preferred embodiment, the first and second carrier portions being trolleys may be connected to each other via the trolley separation means. In a most preferred embodiment, the trolley separation means may be one or more actuators, which are capable of selective separation of the trolleys by extension of actuating rams.

In an alternative embodiment, the first and second carrier portions may be sheaves mounted within a single trolley. One or both of the carrier portions may therefore be in sliding engagement with the single trolley such that separation of the carrier portions is achieved through sliding the sheaves to the desired position.

In a preferred embodiment, the supporting means may be an arrangement of pulleys and sheaves together with a cable set, arranged on the trolley and the spreader assembly whereby the spreader assembly is suspended from the carrier portions by the cables.

The cable set may be a plurality of cables whereby the first plurality of cables is connected to a hoist at one end and a first engagement portion at an opposed end, said cables passing through the carrier portion and directing downwards to the engagement portion. Correspondingly the second plurality of cables may span from a second hoist to the second engagement portion via the second carrier portion.

Thus, the load carried by the first engagement portion is passed directly to the first carrier, and accordingly the load carried by the second engagement portion is passed to the second carrier portion. Rather than a redistribution of weight about a single cable set suspended from a single trolley, the trolley arrangement for the present invention acts as two distinct trolleys maintaining the cables in a vertical arrangement. The present invention has all the advantages of a unitary structure by maintaining the engagement portions and carrier portions in respective and selectably fixed relation through the separation means. Thus, movement of the containers becomes a single action despite the load bearing arrangement, being in a relatively discreet arrangement.

In a second aspect, the invention provides a hoist mechanism for controlling the vertical motion of a duel spreader assembly, said assembly having at least first and second spreader units, said hoist mechanism comprising a hoist drum, a first cable set connecting the first spreader unit to the hoist drum; a second cable set connecting the second spreader unit to the hoist drum, wherein activation of the hoist mechanism causes the hoist drum to rotate, to lift or lower the first and second spreader units simultaneously.

Thus, by eliminating the need for a second hoist drum, firstly this has the advantage of not requiring synchronization between hoists operating on the associated spreader units. More importantly, however, there is significant saving in infrastructure in that the cost saving involved with a second hoist drum, a gearbox and cables is substantial.

In a preferred embodiment, the hoist drum may be mounted to a fixed structure such as a fixed crane. Thus, cables projecting from the hoist drum may be directed horizontally, then directed downward from the trolley. In an alternative embodiment, the hoist drum may be mounted directly to the trolley and therefore projecting cables vertically downward such that the spreader assembly is directly supported by the hoist.

In a third aspect, the invention provides a hoisting system comprising a hoisting means, a spreader assembly, a cable termination assembly and a cable connected at a first end to the hoisting means and connected at an opposed second end to the cable termination assembly. Said spreader assembly engaged with said cables intermediate the hoisting means and termination assembly such that the vertical position of the spreader assembly is determined by activation of the hoisting means, wherein at least one of said cables is connected to the termination assembly via at least one trimming actuator such that the relative position of said at least one cable is selectively adjustable on activation of the trimming actuator and consequently adjusting the orientation of the spreader assembly.

It is recognized that a shortcoming of the prior art relating to duel spreader arrangements is the ability to handle the plurality of containers in an individual manner. Whilst in an ideal situation, the freight devices or containers may be positioned on flat ground, perfectly parallel to each other and delivered in an identical orientation, this will not always be the case. The containers may be of different sizes, located on a slope or maybe delivered it to the deck of a listing ship. Thus there will be circumstances when it will be necessary to treat the containers as individual items whilst still maintaining the need to transport them simultaneously. Thus the present invention provides a means by which the orientation of one spreader unit may be adjusted relative to a second spreader unit. This adjustment may be in terms of any one or a combination of relative longitudinal offset, relative inclination in the vertical plane, inclination of both spreader units in the vertical plane, longitudinally and transversely.

In a preferred embodiment, each of the cables within the hoisting system may include a trimming actuator whereby adjustment of the relative position of the spreader units is provided for three rotational degrees of freedom and one translational degree of freedom, being vertical position.

In a fourth aspect, the invention provides a trimming assembly engaged with a hoisting, system for adjusting the height of a portion of a head frame engaged by said hoisting system, said hoisting system comprising a hoist and a plurality of cables passing from the hoist to the head frame;

the trimming assembly comprising at least one trimming cylinder in communication with at least one of said cables;

wherein activation of the trimming cylinder lengthens or shortens the path followed by the at least one cable, said lengthening or shortening causing a raising or lower of the portion of the head frame.

DESCRIPTION OF PREFERRED EMBODIMENT

It will be convenient to further describe the present invention with respective to the accompanying drawings which illustrate possible arrangements of the invention. Other arrangements of the invention are possible and consequently the particularity of the accompanying drawings is not to be understood as superseding the generality of the proceeding description of the invention.

FIG. 1 shows the hoist mechanism 5 mountable within a fixed structure (not shown).

Figure 1:
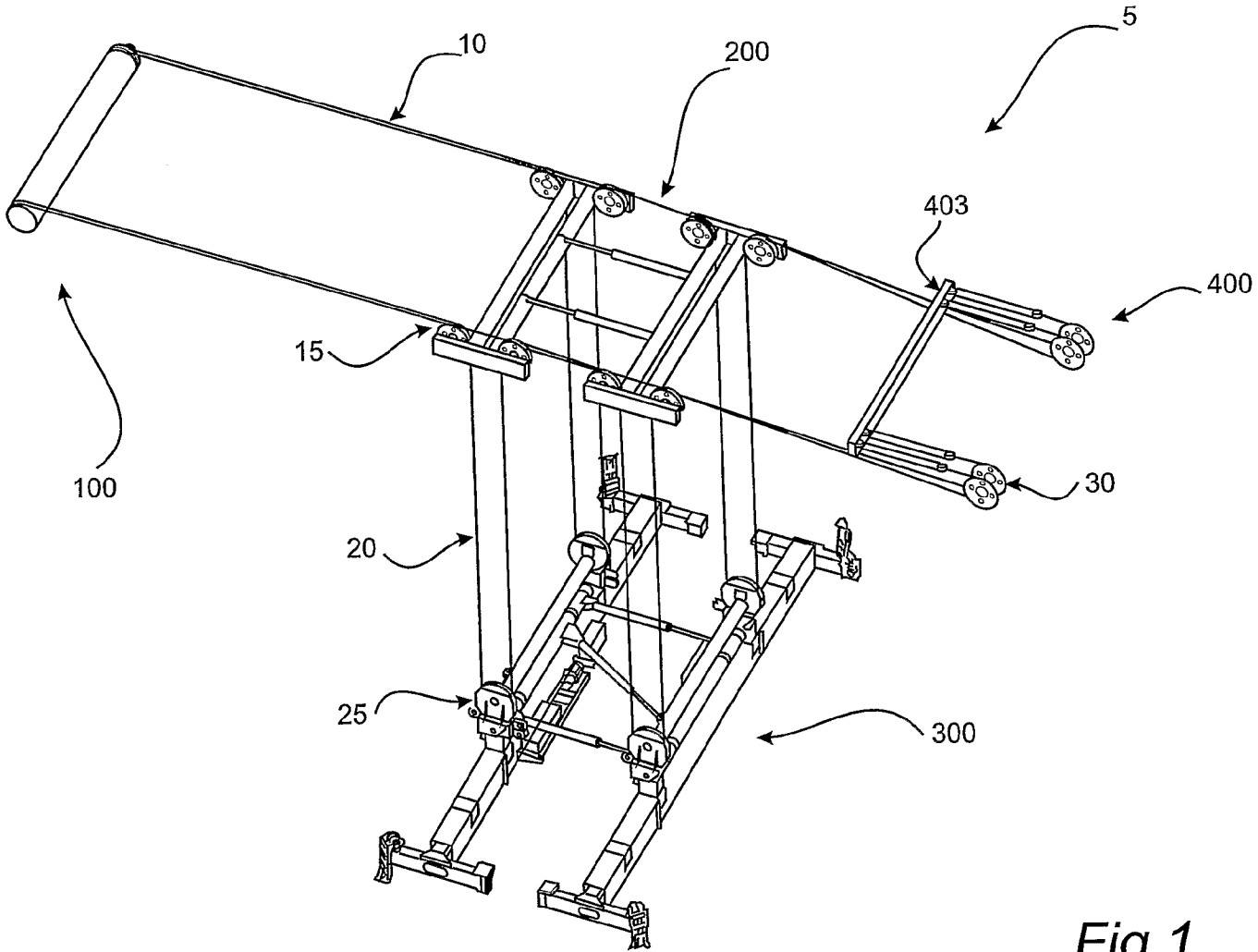
FIG. 1 is an isometric view of the hoist mechanism according to one embodiment of the present invention.

In broad terms, the hoist mechanism 5 according to this embodiment, comprises a single hoist drum 100, a split trolley 200, a duel spreader assembly 300 and an end block assembly 400.

Cables running continuously from the hoist drum 100 to the end block assembly 400 pass through the split trolley 200 and are directed downwards to engage the spreader assembly 300 and terminate at the end block assembly 400. Thus, rotation of the hoist drum 100, with the end assembly 400 being essentially fixed, will cause the duel spreader assembly 300 to lift or lower a load attached to this spreader assembly 300.

Figure 2:
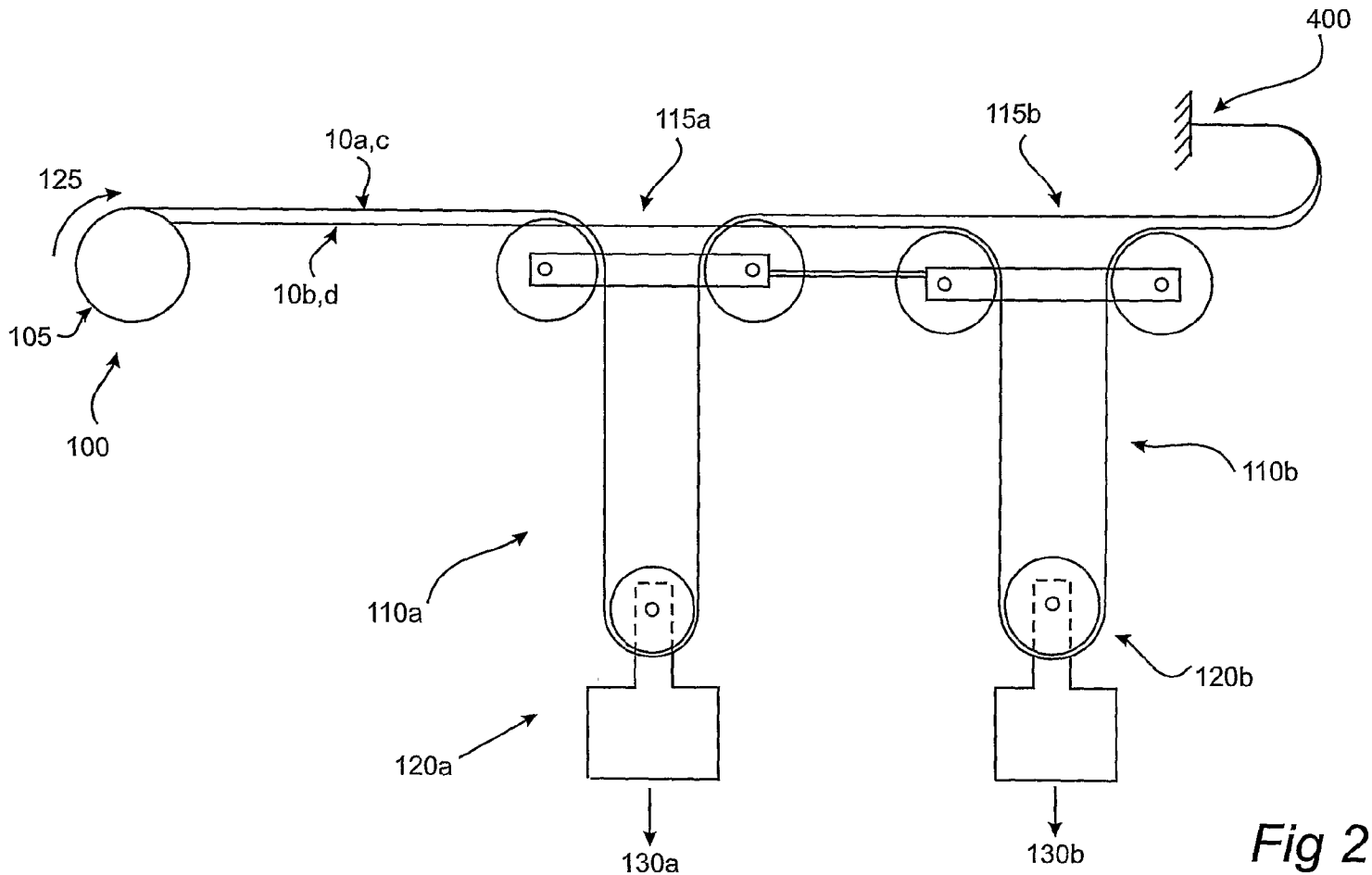
FIG. 2 is a schematic view of the operation of the single hoist according to another embodiment of the present invention.

FIG. 2 shows a schematic view of the operation of the single hoist 100. In this embodiment, the single hoist comprises a single drum 105 to which cables 10*a,c* for the first carrier assembly 110*a* are attached. Further, a second cable set 10*b,d* also are attached to the single hoist drum 105 and engage the second carrier assembly 110*b*. Both cable sets 10*a,b* and 10*b,d* terminate at the end block assembly 400, which provides a substantially fixed point.

Hoist systems of the prior art, for a duel carrier arrangement, will provide two hoist drums, each operating with a single carrier assembly. Thus lifting and lowering of the freight devices attached to the carrier assemblies require synchronization of the two hoist drums to ensure the containers are lifted and lowered at the same rate and from the same position. Whilst a small differential may be accommodated, it is still a technically difficult exercise to synchronize these distinct hoists.

This is where the single hoist system according to one aspect of the present invention is of particular advantage. For the manipulation of two or more freight devices, it follows that the loads will travel at the same rate, both vertically and horizontally, and so permit the use of a single hoist drum 105. By connecting two sets of cables 10*a,c* and 10*b,d*, rotation 125 of the single hoist drum 105 will operate both cable sets 10*a,c* and 10*b,d* simultaneously, which will respectively cause both of the carrier assemblies 110*a,b*, to move 130*a,b* at the same rate. Thus, so long as the pick-up point of the freight devices for each of the carrier assemblies 110*a* and 110*b* is the same, then it follows that there will be little or no differential between the position of the containers when they are lifted and lowered.

Figure 3:
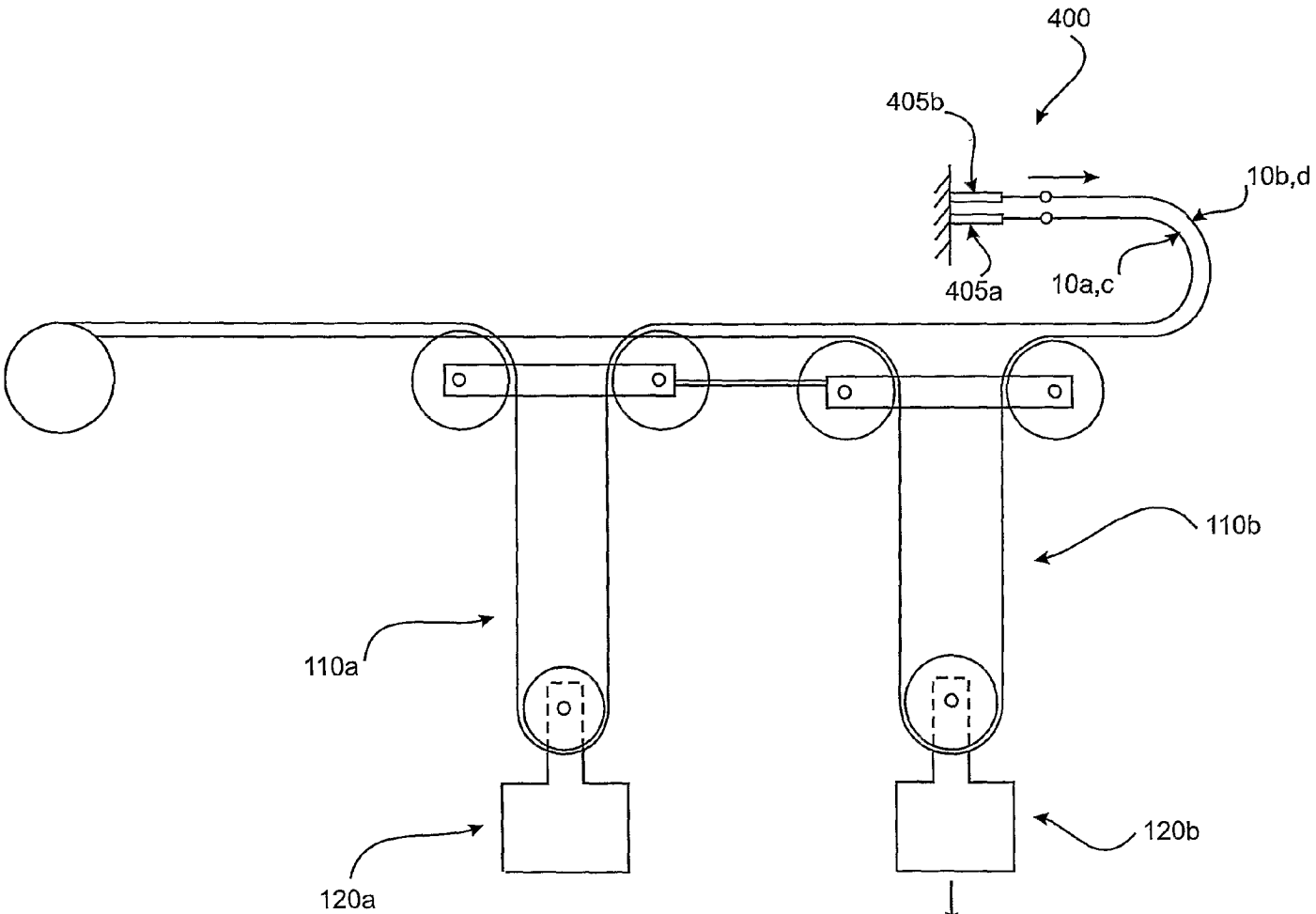
FIG. 3 is a schematic elevation view of the trimming cylinders according to another embodiment of the present invention.

FIGS. 1 and 3 also shows the end block assembly 400 according to a further aspect of the present invention. The end block assembly 400 comprises an anchor block 403, which is fixed to the fixed structure (not shown). Any suitable anchor block 403 will suffice for the present invention so long as it is capable of carrying the loads applied by the cable ends and also accommodating trimming cylinders 405*a,b* which connect the cable ends to the anchor block 403. The trimming cylinders 405*a,b* may be hydraulically, pneumatically or electrically operated, so long as they are capable of firstly, holding the cable ends in a fixed position resisting the applied loads and when in use, being able to adjust the position of the cable end for any of the activated trimming cylinders 405*a,b*.

To demonstrate the effect of the trimming cylinders, an example is shown in FIG. 3, whereby a trimming cylinder 405*b* is associated with a second carrier assembly 110*b*. Extending the ram of the trimming cylinder 405*b* has the effect of extending the length of relevant cable 10*b,d*. This has a consequential effect on the position of the second spreader assembly 120*b* by lowering 410 the load carried by the second spreader assembly 120*b*. Thus, whilst the single hoist 100 operates to maintain the loads in the same position relative to each other, the trimming cylinders 405*a,b* of the end block assembly 400 operate to make incremental adjustments of the relative position of the loads.

Thus, if two freight devices, such as shipping containers, are to be lifted from a ship that may be listing, or from a truck positioned on a slope, then the containers may be engaged and lifted simultaneously by "trimming" the position of each of the spreaders to accommodate the different positions of the containers. On engaging and lifting the containers, the relative position may be adjusted again by the trimming cylinders 405*a,b* to match the conditions of the ground, ship or truck to which the containers will be moved.

Figure 4:
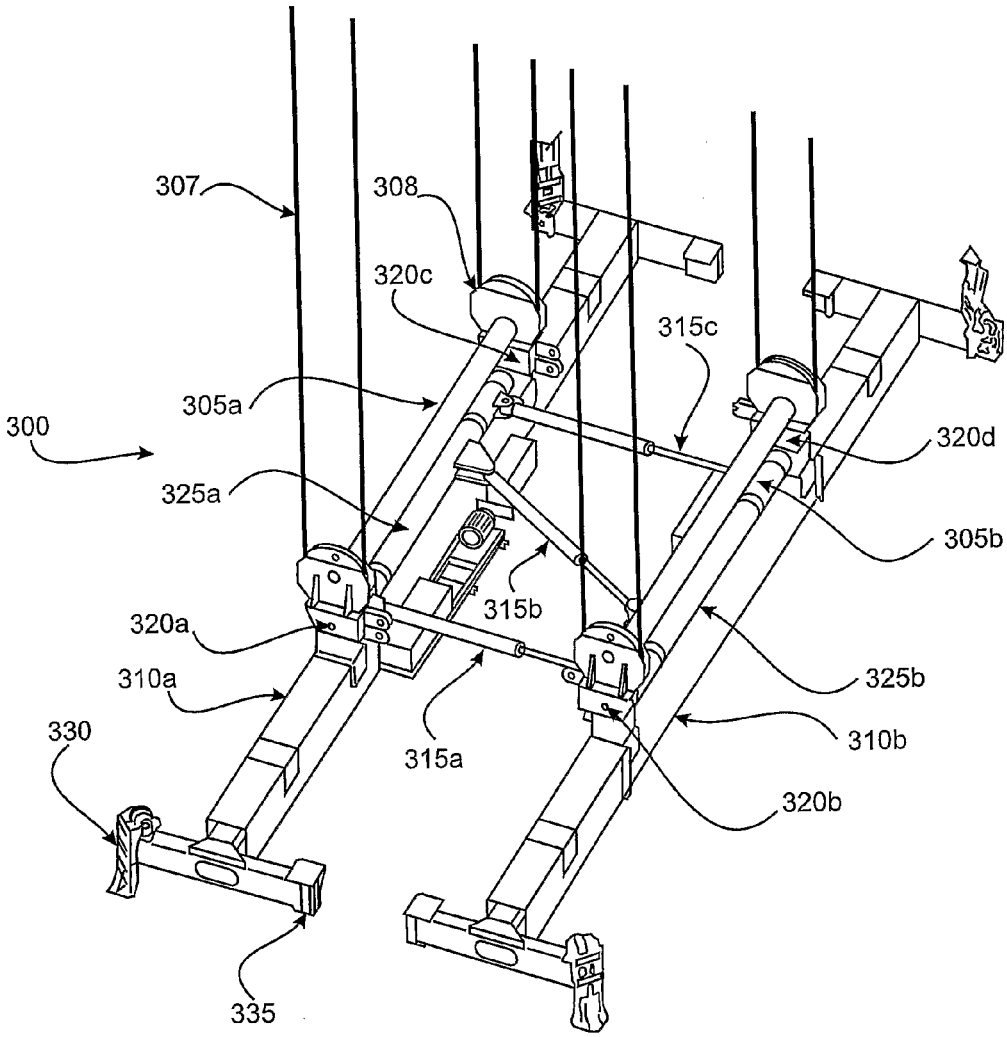
FIG. 4 is an isometric view of the split trolley according to another embodiment of the present invention.

FIG. 4 shows a duel spreader assembly 300 according to a further aspect of the present invention. Whilst the present invention is useful for single spreader hoist systems, many of the inventive features are particularly useful where a duel spreader is incorporated. To this end, the duel spreader assembly 300 according to one aspect of the present invention is provided to be suspended from a trolley carrier unit for instance the split trolley 200 according to another aspect of the present invention.

The duel spreader assembly 300 comprises an upper head frame 305*a,b* mounted to cables 307 projecting from the trolley carrier above. The cables engage with the head frames 305*a,b* through pulleys 308 which permit the cables 307 to pass continuously through. The head frames 305*a,b* are respectively mounted to spreader frames 310*a,b*. The spreader frames 310*a,b* are modified in comparison with existing spreader frames in that they include a conventional attachment, such as twist lock, at peripheral corners 330 and, at internal corners 335 of the spreader frames. Thus, the spreader frames 310*a,b* may act individually so that each is attached to a single freight device or alternatively, the spreader frames may be drawn together and connected so as to act as a single spreader frame engaging a single freight device.

The adapted spreader frames 310*a,b* are mounted to the head frames 305*a,b* through shear pins 320*a* to *d*. Whilst it is possible to mount connection, such as twist blocks, to the header frames 305*a,b* to engage with the spreader frames 310*a,b*, the nature of this connection is such that a rapid engagement is not required and can conveniently be done on the ground prior to use. Thus, the use of shear pins 320*a* to *d* provide a convenient and simple means to mount the spreader frames to the head frames. Typically, shear pins of 100 mm diameter can be used, but this will be subject to the loads for which the apparatus is rated, which will be clear to the skilled addressee in the circumstances.

A challenge for duel spreader frames of the prior art is how to cope with clearance of adjacent containers held by the duel spreader frames. In the case of the present invention, there are provided in this embodiment, hydraulic actuators 315*a,b,c* located on the head frames 305*a,b*. The actuators 315*a,b,c* are arranged to have two outer actuators 315*a,c* acting perpendicular to the major axis of the spreader units and a third inner actuator 315*b* acting within the same plane as the outer actuators 315*a,c*, but inclined to the spreader frame main axis. This particular combination of actuators permits a variable range of orientations of the spreader frames to accommodate the different positions of containers to be lifted or lowered. It is recognized that it will not be in every case that containers will be located on flat ground and perfectly square to each other. In situations where the containers are offset or at inclined angles to each other, that the duel spreader assembly 300 according to the present invention, will still be capable of engaging and lifting said containers.

For instance where the containers are offset from one another by activating the internal actuator 315*b*, the spreader frames will move in opposed directions, co-linear with their major axis, that is one forward and one back.

Alternatively, if the major axes of the containers are inclined to each other, so too must the spreader frames be oriented. In this case, the internal actuator 315*b* will be free to move and the first and second outer actuators 315*a,c* differentially activated so as to rotate the spreader frames relative to each other until the desired inclined orientation is achieved.

These movements are based upon the spreader frames remaining in the same plane. If, however, the spreader frames need to be outside of a common plane, this may be accommodated according to this embodiment of the present invention. Circumstances where it may be necessary to use the spreader frames in different planes include when containers of different heights must be lifted or where the containers are on a slope, such as for a truck on an incline, or from a ship deck listing to one side. In this case, the portions of the head frames 305*a,b* to which the actuators 315*a,b,c* are attached, are in fact rotatable 325*a,b*. Thus, by releasing a brake on the rotatability of these portions 325*a,b*, the spreader frames can be hoisted at different heights with the actuators acting to maintain and adjust these height differences.

It should be noted that in a further aspect of the present invention, the trimming cylinders of the end block assembly 400 may be used to adjust the height of the spreader frames 310*a,b* so further adding to the flexibility of this embodiment of the present invention.

Figure 5:
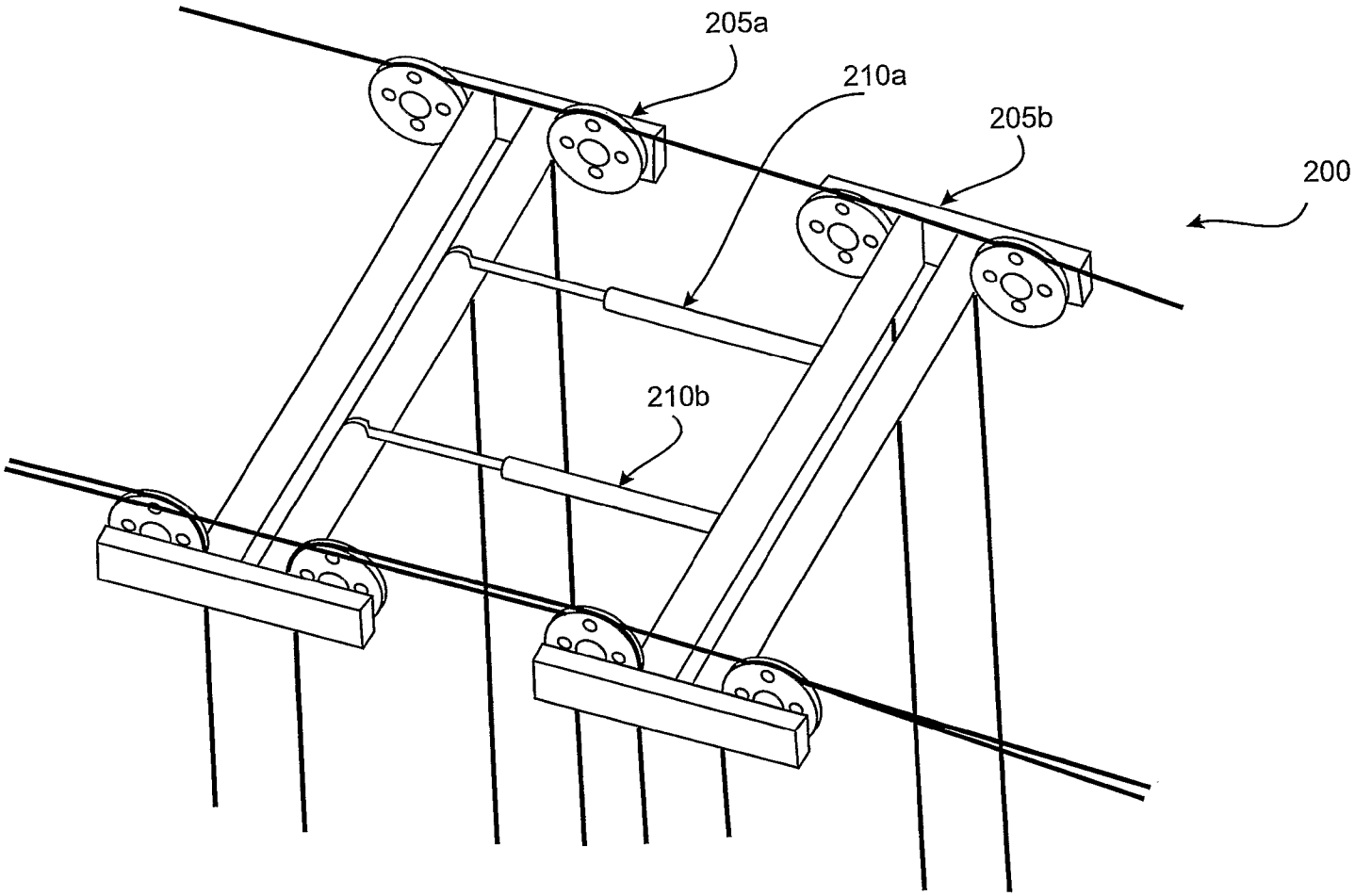
FIG. 5 is an isometric view of the duel spreader assembly according to an embodiment of the present invention.

FIG. 5 shows a split trolley 200 according to one aspect of the present invention. Whereas conventional hoisting systems will have a unitary carrier acting as the trolley from which the spreader assembly will be suspended, the present invention in this embodiment provides for two discreet carriers 205*a,b* linked by actuators 210*a,b*. The split trolley according to this embodiment is particularly suited for use with a duel spreader arrangement. In such an arrangement whereby spreader frames will separate so as to accommodate side by side containers, trolley carriers according to the prior art are in fixed relation. Therefore as the spreader frames separate, the cables from which the spreader frames suspend will become more and more inclined, leading to greater tension in the cables to accommodate this angle. In the present invention, the actuators 210*a,b* are activated so to separate the discreet carriers 205*a,b* to a position corresponding to the separation of the duel spreader frames such that the cables become substantially vertical.

Whilst the trolley units 205*a,b* are discreet units, said carriers are nevertheless linked through the actuators 210*a,b*. Thus, movement of the trolley as a whole unit need only rely upon one of said carriers 205*a* to have a motor such that the trolley will run along the crane rails of the fixed structure. To this end the split trolley 200 is in fact divided into a master trolley 205*a* and a slave 205*b*, whereby the master trolley 205*a* is motorized having a motor of sufficient capacity to also drive the slave unit.

Figure 6:
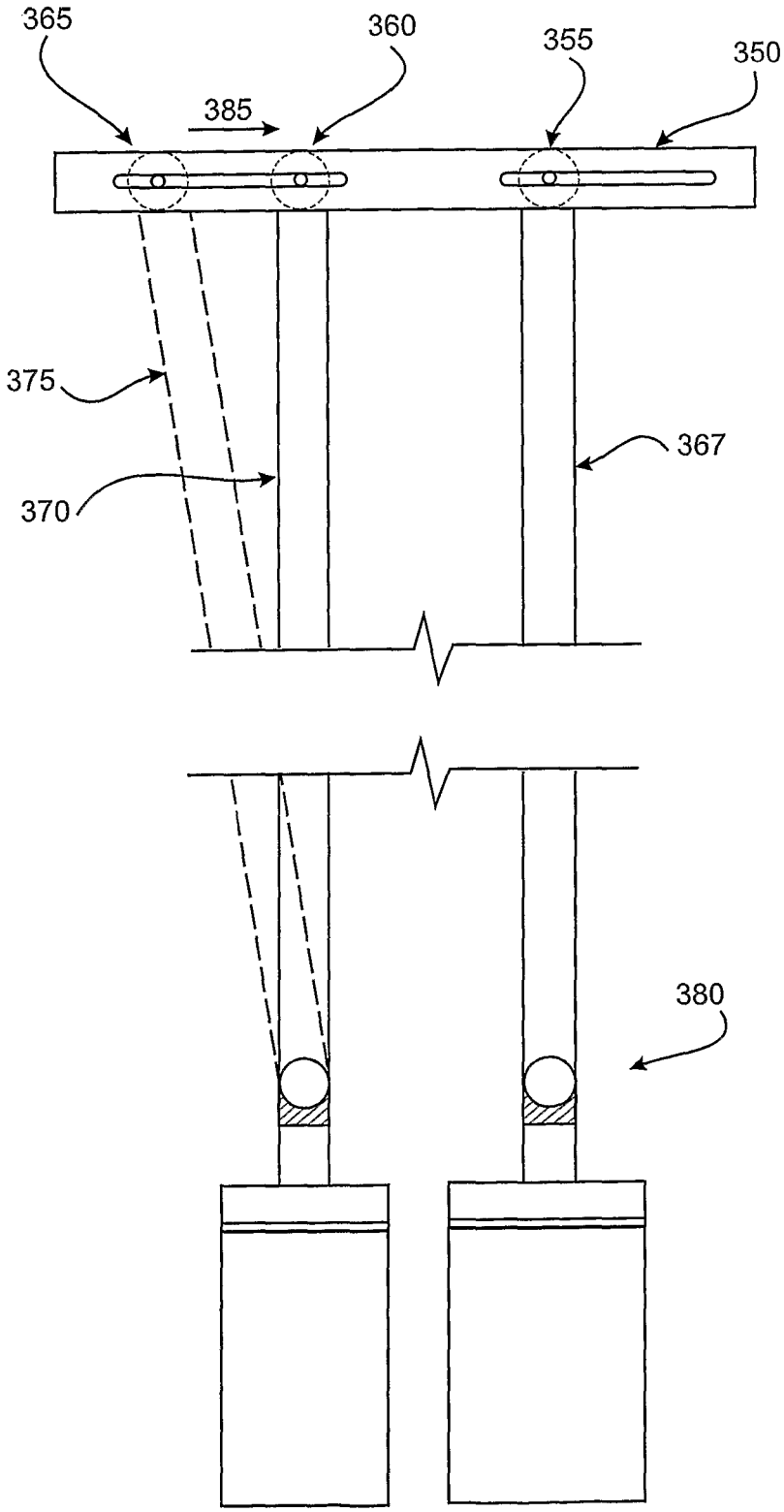
FIG. 6 is an elevation view of the hoist mechanism according to a further embodiment of the present invention.

FIG. 6 shows a further embodiment of the present invention, whereby the split trolley involves movable sheaves 355, 360, 365 within a single trolley carrier 350. As with previous embodiments, the arrangement includes a trolley 350 from which is suspended, using cables 367, 370, 375, a spreader assembly 380.

In the embodiment, a first position of one carrier 365 is shown whereby the corresponding cables 375 are inclined, and so increasing the applied load. The second carrier 355 has cables 367 in the desired position, being substantially vertical, and hence it is desirable to move the first carrier 365 so as to have these corresponding cables 375 also vertical.

Hence, the first carrier 365 is moved 385 to a position 360, whereby the cables are now substantially vertical and thus reducing the load in the cables, and otherwise benefiting from the more desired arrangement.

Figure 7:
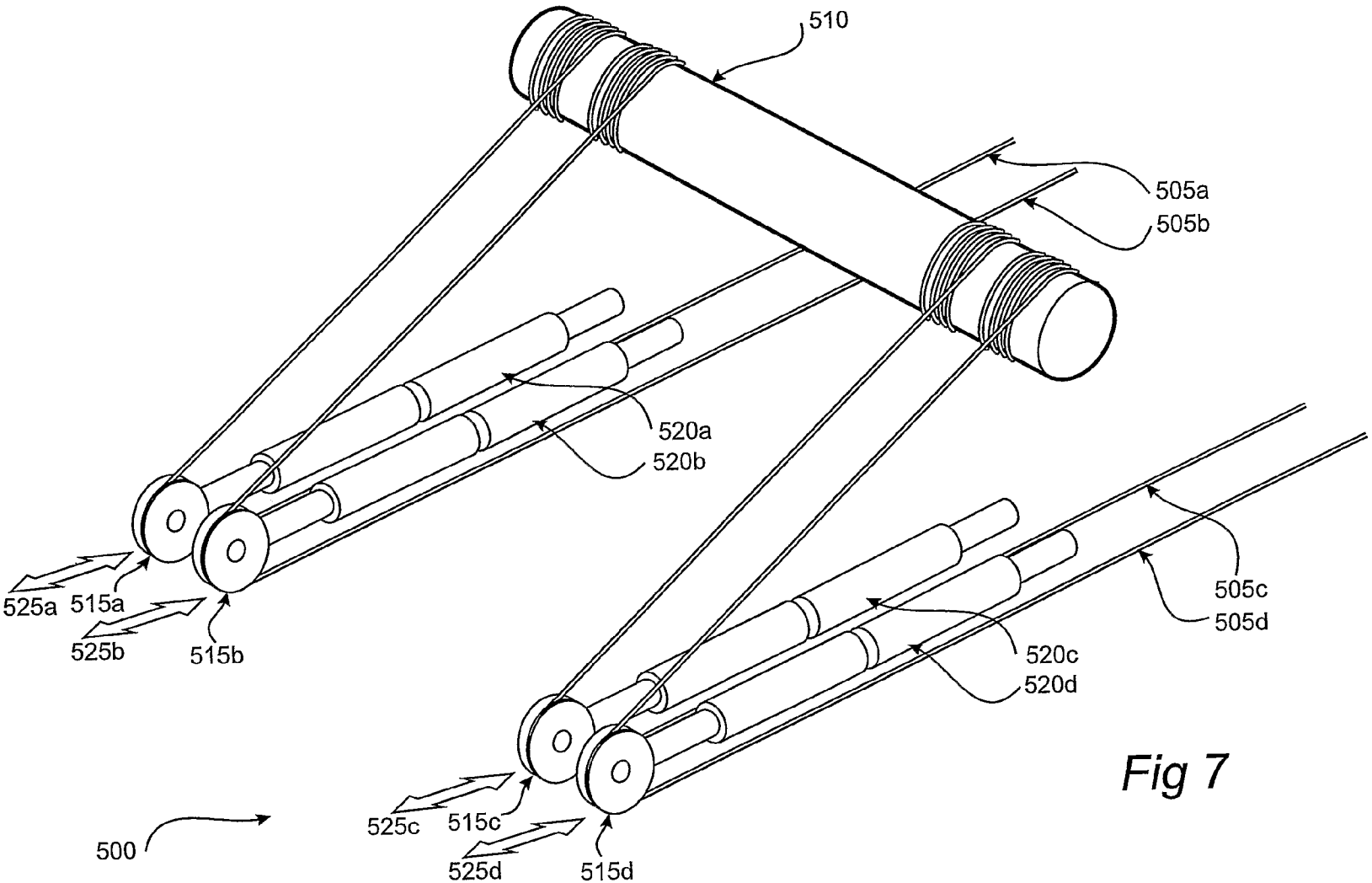
FIG. 7 is an isometric view of the trimming cylinders according to a further embodiment of the present invention.

As a further alternative arrangement, FIG. 7 shows an embodiment of the trimming cylinders 500. In this arrangement, a hoist drum 510, controls cables 505 *a* to *d*. The cables pass through sheaves before progressing to a trolley and head frame (not shown). The intent of trimming cylinders is to vary the length of cables either individually or collectively. In the previous embodiment, this was achieved by extending an in-line cylinder. In this embodiment, the lengthening comes from decreasing the path through which the cable passes. Specifically, the trimming cylinders 520 *a* to *d* bear directly on the sheaves 515*a* to *d*, and in fact, do not contact the cable. The sheaves 515 *a* to *d* are movable subject to the force applied by the cylinders 520 *a* to *d*. Thus, by retracting the cylinder, the sheaves 515 *a* to *d* move 525 *a* to *d* accordingly. By moving inwards, the path followed by the cables 505 *a* to *d* is shortened, leading to the corresponding portion of the head frame lowering relative to the non-affected cables. Conversely, by extending the cylinder, the sheaves are moved in the other direction, lengthening the path, leading to the corresponding portion of the head frame lifting relative to the remaining portions.

The claims defining the invention are as follows:

1. A trolley assembly comprising:

means for supporting a spreader assembly, said means including:

cables;

a first carrier portion and a second carrier portion, said carrier portions in rolling engagement with a crane beam;

first and second carrier portions;

a trolley separation means for selectively varying the relative position of the first and second carrier portions;

a spreader assembly, said spreader assembly comprising:

a first and a second spreader frame;

a first and a second head portions which respectively engage with said first and second spreader frames; and a spreader separation means for adjusting the relative position of the head portions;

wherein said first spreader frame is connected to said first carrier portion and said second spreader frame is connected to said second carrier portion by said cables; and wherein when the spreader separation means displaces said first and second head portions, the orientation between the first head portion and the first carrier portion and the orientation between the second head portion and the second carrier portion is maintained by the trolley separation means displacing the relative position of the first carrier portion with respect to the second carrier portion.

2. The trolley assembly according to claim 1, wherein the trolley separation means comprises a plurality of actuators arranged to selectively vary the relative position of the carrier portions.

3. The trolley assembly according to claim 2, wherein the actuators are any one or a combination of hydraulic actuators, pneumatic actuators or electrically-driven actuators.

4. The trolley assembly according to claim 1, wherein the supporting means comprises cables, sheaves and pulleys arranged to suspend the spreader assembly from at least one of said carrier portions.

5. The trolley assembly according to claim 1, wherein the first carrier portion is a master carrier and the second carrier portion is a slave carrier engaged with the master carrier through the trolley separation means, said master carrier driven so as to move the trolley assembly along the rail or crane beam.

6. The trolley assembly according to claim 1, wherein the at least two head portions include a plurality of pulleys for engaging the cables.

7. The trolley assembly according to claim 1, wherein the relative position of the first and the second carrier portions varied by the trolley separation means, corresponds to the relative position of the head portions adjusted by the spreader separation means.

8. The trolley assembly according to claim 1, further including a hoist mechanism for controlling the vertical motion of the spreader assembly, wherein said first spreader frame and said first head portion form a first spreader frame unit, and wherein said second spreader frame and said second head portion form a second spreader frame unit, wherein said cables comprise a hoist mechanism comprising a hoist drum, a first cable set connecting the first spreader frame unit to the hoist drum; a second cable set connecting the second spreader frame unit to the hoist drum, wherein activation of the hoist mechanism causes the hoist drum to rotate, and consequently to lift or lower the first and second spreader frame units simultaneously; and each cable set is connected directly to at least one trimming actuator in series with said cable set such that the relative position of said cable set is selectively adjustable on activation of the at least one trimming actuator and consequently adjusting the orientation of the spreader frame units.

9. The trolley assembly according to claim 8, wherein the hoist drum is mounted to a carrier portion.

10. The trolley assembly according to claim 8, wherein the hoist drum is mounted to a fixed structure with the cables passing through the first and second carrier portions with said first and second frame spreader units supported by the cables beneath the first and second carrier portions.

11. The trolley assembly according to claim 1, further including a hoisting system comprising:

a hoisting means and a cable termination assembly, wherein the cables are connected at a first end to the hoisting means and connected at an opposed second end to the cable termination assembly;

wherein said spreader assembly is engaged with said cables intermediate the hoisting means and termination assembly such that the vertical position of the spreader assembly is determined by activation of the hoisting means;

said cable termination assembly including an anchor block mounted to a fixed structure and adapted to anchor the opposed second end of the cables; and at least one trimming actuator positioned intermediate an end of at least one cable and the termination assembly;

wherein the at least one of said cables is connected to the at least one trimming actuator in series such that the relative position of said at least one cable is selectively adjustable on activation of the at least one trimming actuator and consequently adjusting the orientation of the spreader assembly;

wherein the first spreader frame unit is engageable with a first container, and said second spreader frame unit is engageable with a second container, said at least one trimming actuator configured to adjust the vertical position of the first container relative to the second container.

12. The trolley assembly according to claim 11, wherein the hoisting means includes a hoist mechanism having at least one hoist drum.

13. The trolley assembly according to claim 11, wherein the cables are continuous from the hoisting means to the cable termination assembly with the spreader assembly engaging the cables through a plurality of pulleys or sheaves.

14. The trolley assembly according to claim 11, wherein each of the cables engages a pulley or sheave of the spreader assembly in a plurality of locations so as to maintain the horizontal and vertical orientation of the spreader assembly, whereby said vertical and horizontal orientation is varied to accommodate placement of the spreader assembly on activation of the trimming actuator.

15. The trolley assembly according to claim 14, wherein each cable is connected to the termination assembly via a respective trimming actuator such that the adjustment of the orientation of the spreader assembly includes activation of more than one trimming actuator.

16. A trolley assembly comprising a spreader assembly;

means for supporting the spreader assembly, said means including cables, said spreader assembly engageable with at least two freight devices;

a first carrier portion and a second carrier portion, said carrier portions mounted to a single carrier, with the first carrier portion fixed to the single carrier and the second carrier portion in sliding engagement with the single carrier, said single carrier in rolling engagement with a crane beam;

a trolley separation means arranged to bias the second carrier portion to move to a desired position relative to the first carrier portion within the carrier;

the supporting means adapted to connect the spreader assembly to at least one of said carrier portions;

wherein the spreader assembly comprises:

at least two head portions and two spreader frames, each head portions being engaged with a spreader frame, the spreader assembly engageable with at least two freight devices, each freight device respectively engaged with a spreader frame; and a spreader separation means for adjusting the relative position of the head portions, in a direction parallel to that of the trolley separation means.

* * * * *